US009856590B2

(12) United States Patent
Sommer

(10) Patent No.: US 9,856,590 B2
(45) Date of Patent: Jan. 2, 2018

(54) METHOD OF MAKING A SPUNBOND WEB FROM FILAMENTS

(75) Inventor: Sebastian Sommer, Troisdorf (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 1109 days.

(21) Appl. No.: 12/991,362

(22) PCT Filed: May 26, 2009

(86) PCT No.: PCT/EP2009/003726

§ 371 (c)(1),
(2), (4) Date: Jan. 26, 2011

(87) PCT Pub. No.: WO2009/144004

PCT Pub. Date: Dec. 3, 2009

(65) Prior Publication Data

US 2011/0147977 A1 Jun. 23, 2011

(30) Foreign Application Priority Data

May 29, 2008 (EP) ..... 08009814

(51) Int. Cl.
*D01D 5/098* (2006.01)
*D01D 7/00* (2006.01)
(Continued)

(52) U.S. Cl.
CPC ..... *D04H 3/11* (2013.01); *D04H 3/005* (2013.01); *D04H 3/105* (2013.01); *D04H 3/16* (2013.01)

(58) Field of Classification Search
CPC .. D01D 5/098; D01D 7/00; D02J 1/08; D04H 3/02; D04H 3/11
(Continued)

(56) References Cited

U.S. PATENT DOCUMENTS 4,582,750 A * 4/1986 Lou et al. ..... 442/414
5,761,778 A * 6/1998 Fleissner ..... 28/104
(Continued)

FOREIGN PATENT DOCUMENTS

| | | | |
|---|---|---|---|
| CA | 2386389 | A | 8/2004 |
| DE | 10061367 | A | 6/2002 |
| EP | 0900869 | A | 8/1999 |

OTHER PUBLICATIONS

Xiameter PMX-200 Silicone Fluid 50CS, web printout Aug. 24, 2017, https://xiameter.com/EN/Products/Pages/ProductDetail.aspx?.

*Primary Examiner* — Leo B Tentoni
(74) *Attorney, Agent, or Firm* — Andrew Wilford

(57) ABSTRACT

A spunbond nonwoven from thermoplastic filaments is made by spinning the filaments from at least one spinner, cooling and stretching the spun filaments, depositing the cooled and stretched filaments on a surface to form a nonwoven fleece web, and moving the fleece web in a travel direction. A liquid medium is introduced into the moving fleece web and it is then mechanically needled. The mechanically needled web is then subject to a hydraulic or hydrodynamic final consolidation by hydroentanglement to a basis weight of more than 80 g/m$^2$ from a top side as well as from a lower side of the nonwoven fleece web by high-pressure water-jet bars above and below the nonwoven fleece web. O of the bars is upstream of the other bar and has a hpi density that is smaller than that of the other bar and that is equal to at most 40.

15 Claims, 3 Drawing Sheets

(51) Int. Cl.

| | |
|---|---|
| ***D02J 1/08*** | (2006.01) |
| ***D04H 3/02*** | (2006.01) |
| ***D04H 3/11*** | (2012.01) |
| ***D04H 3/005*** | (2012.01) |
| ***D04H 3/105*** | (2012.01) |
| ***D04H 3/16*** | (2006.01) |

(58) Field of Classification Search
USPC ..... 264/103, 210.8, 211.12, 211.14, 211.15, 264/555; 28/104, 107
See application file for complete search history.

(56) References Cited

U.S. PATENT DOCUMENTS

| | | | | |
|---|---|---|---|---|
| 5,814,349 | A | 9/1998 | Geus | |
| 5,910,368 | A * | 6/1999 | Ehret | D04H 3/011 428/411.1 |
| 6,112,385 | A * | 9/2000 | Fleissner et al. | 28/104 |
| 6,918,750 | B2 | 7/2005 | Geus | |
| 2001/0005926 | A1* | 7/2001 | Noelle | 28/104 |
| 2003/0057586 | A1* | 3/2003 | Taylor | D01D 5/0985 264/103 |
| 2004/0010894 | A1 | 1/2004 | Goldwasser | |
| 2004/0154731 | A1 | 8/2004 | Sommer | |
| 2005/0120497 | A1* | 6/2005 | Lynde et al. | 15/104.94 |
| 2005/0173842 | A1 | 8/2005 | Sommer | |
| 2006/0057921 | A1* | 3/2006 | Turi et al. | 442/327 |
| 2006/0225952 | A1* | 10/2006 | Takayasu et al. | 181/294 |
| 2009/0026647 | A1* | 1/2009 | Geus | D01D 5/14 264/40.6 |

* cited by examiner

METHOD OF MAKING A SPUNBOND WEB FROM FILAMENTS

CROSS REFERENCE TO RELATED APPLICATIONS

This application is the US-national stage of PCT application PCT/EP2009/003726, filed 26 May 2009, published 3 Dec. 2009 as 2009/144004, and claiming the priority of European patent application 08009814.8 itself filed 29 May 2008.

FIELD OF THE INVENTION

The invention relates to a method of manufacturing a spunbond nonwoven from filaments, in particular from a thermoplastic plastic. Furthermore, the invention also relates to an apparatus for making such a spunbond nonwoven. Within the scope of this invention, the term "filaments" refers particularly to continuous filaments. Continuous filaments differ based on their quasi-continuous length from staple fibers that have much shorter lengths of 10 to 60 mm, for example.

BACKGROUND OF THE INVENTION

Methods and apparatuses of the type defined in the introduction are known in various embodiments from practice. In these methods, the filaments are spun with the help of a spinner and are laid down on a deposition surface, in particular on a conveyor belt and/or a screen belt to form the nonwoven fleece web. It is known that this nonwoven fleece web may be preconsolidated by water-jet consolidation. The water-jet treatment is usually performed from only one side of the nonwoven fleece web.

Thereafter, the preconsolidated filaments deposited and/or nonwoven fleece web is released from the screen belt and sent to a separate water-jet unit for water-jet consolidation and/or for hydraulic final consolidation. —At a high basis weight of the nonwoven fleece web above approx. 80 g/m$^2$, in particular above 100 g/m$^2$ and especially above 150 g/m$^2$, it has been found that only at very high water pressures is it possible to preconsolidate the dense filament deposit and/or nonwoven down into the lower filaments. This is associated with a relatively high energy consumption. Moreover, this hydrodynamic preconsolidation compacts the nonwoven fleece web greatly. In the hydraulic final consolidation, the water jets then strike a relatively dense barrier that they must penetrate in such a way that the filaments become entangled with one another throughout the thickness of the nonwoven. In the case of nonwoven fleece web of a higher basis weight in particular, an elevated water pressure and thus a relatively high energy consumption are required. In this hydraulic final consolidation, it is customary for the energy input of the water-jet nozzles stacked one after the other to be increased from the upstream nozzles to the additional nozzles. The nozzles having the highest energy input are at the end or in the middle of the water-jet unit with regard to the travel direction of the nonwoven fleece web. In the case of nonwoven fleece web of a very high basis weight, the energy input is so high that this method is no longer feasible.

An alternative approach consists of clamping the loose mat of deposited filaments and/or nonwoven fleece web between two corotating screen belts and then performing the water-jet treatment through these screen belts. In this procedure, however, the screen belts deflect a portion of the water energy in an unfortunate manner, so that here again, the energy balance leaves much to be desired.

OBJECT OF THE INVENTION

On the other hand, the object of the present invention is based is to provide a method of the type described above with which a nonwoven fleece web can be consolidated in a simple and less complex manner with the lowest possible energy consumption or total energy consumption, in particular at the higher basis weights of more than about 80 g/m$^2$ and especially more than about 100 g/m$^2$. The inventive method is most particularly suitable for nonwoven fleece web having basis weights above 150 g/m$^2$. Another object of the invention is to provide a corresponding apparatus for making a spunbond nonwoven.

SUMMARY OF THE INVENTION

To attain these objects, the invention teaches a method of making a spunbond nonwoven from filaments, in particular from a thermoplastic plastic, wherein

- the filaments are spun from at least one spinner, then are cooled and stretched and deposited on a surface to form the nonwoven fleece web,
- the nonwoven fleece web is preconsolidated by mechanical needling,
- the nonwoven fleece web is then final consolidated by hydrodynamic consolidation, and
- the final consolidated nonwoven fleece web has a basis weight of more than 80 g/m$^2$, preferably more than 100 g/m$^2$, and especially preferably more than 150 g/m$^2$.

Mechanical needling refers to the needling of the nonwoven fleece web using a needle assembly and/or a needle loom that usually has a plurality of needles that penetrate into the nonwoven fleece web during needling. —Hydrodynamic consolidation or hydraulic consolidation refers to consolidation using high-pressure water jets that act on the nonwoven fleece web.

The titer of the filaments in the nonwoven fleece web advantageously amounts to 0.6 to 10 den, preferably 1 to 6 den and especially preferably 1 to 3 den. In the case of filament mixtures, the titer of the filaments may also be 0.05 to 20 den. The inventive method has proven to be especially advantageous in particular at lower titers between 0.05 den and 10 den, preferably between 0.05 and 6 den because the fiber deposition and/or the nonwoven fleece web then is relatively dense and nevertheless consolidation is possible with a relatively low energy consumption. The nonwoven fleece web of finer fibers produced according to this invention are characterized by an advantageously high strength.

It is within the scope of this invention for the filaments to be cooled in a cooling chamber after emerging from the spinner and then to be stretched in a mechanical stretcher and/or stretched aerodynamically. It is also within the scope of the invention for the stretched filaments to be guided through a spreader downstream of the stretcher, this spreader having at least one diffuser. Downstream of the spreader and/or downstream of the diffuser, the filaments are then deposited to form the nonwoven fleece web. Deposition refers in particular to a deposit belt and/or a foraminous belt.

According to a very preferred embodiment of the invention, after deposition of the filaments to form the nonwoven fleece web and before preconsolidation by mechanical needling, a liquid medium is applied to the nonwoven fleece web and/or introduced into the nonwoven fleece web. It is within the scope of the invention for the liquid medium to act as a lubricant for the mechanical needling. Such a lubricant lowers the binding of the (dry) filaments into the nonwoven fleece web and facilitates the mechanical needling and/or lowers the required forces and thus the energy expenditure in mechanical needling. Preferably, at least one liquid medium from the group of "water, aqueous solution, aqueous mixture, oil, oily suspension" is introduced into the nonwoven fleece web. According to preferred embodiments, water and/or an aqueous solution and/or an aqueous mixture is/are introduced into the nonwoven fleece web.

A very preferred embodiment of the invention is characterized in that a hydrophilic liquid medium is introduced into the nonwoven fleece web. A hydrophilic liquid medium here is a liquid that imparts a hydrophilic character to the nonwoven fleece web in comparison with the dry nonwoven fleece web just deposited. Dry nonwoven fleece web here and below refers to the filament deposit and/or the nonwoven fleece web before the introduction of the liquid medium and/or the hydrophilic liquid medium. The invention is based on the discovery that with a hydrophilic liquid medium, the hydrodynamic final consolidation downstream from the preconsolidation is also facilitated. According to one embodiment of the invention, the premoistening that is to be described below between the preconsolidation and the hydrodynamic final consolidation may then be omitted.

The liquid medium and/or the hydrophilic liquid medium is advantageously introduced into the nonwoven fleece web by at least one spray bar and/or by at least one overflow weir. An embodiment that deserves special attention within the scope of the invention is characterized in that the liquid medium introduced into the nonwoven fleece web is pulled into the nonwoven fleece web by at least one suction device. To do so, preferably at least one suction field and/or at least one suction device is provided underneath a screen belt holding the nonwoven fleece web. A subatmospheric pressure is advantageously applied to the suction field and/or a vacuum is advantageously applied by the suction device, the subatmospheric pressure preferably being in the range between 50 and 400 mbar. According to a recommended embodiment, the intake or suction of liquid medium is accomplished via at least one suction device having at least one suction slot extending across the travel direction of the nonwoven fleece web. The introduction of the liquid medium, in particular the hydrophilic liquid medium into the nonwoven fleece web and the input and/or suction of the liquid medium thereby advantageously performed has proven especially successful for nonwoven fleece web having a basis weight of more than 130 g/m$^2$, in particular for nonwoven fleece web having a basis weight of more than 150 g/m$^2$.

According to the recommended embodiment of the invention, the liquid medium and/or the hydrophilic liquid medium is preferably introduced into the nonwoven fleece web in an amount of 0.2 to 50%, preferably 0.5 to 30%, more preferably 0.5 to 20% and especially preferably 0.5 to 15%, based on the basis weight of the dry nonwoven fleece web and/or the basis weight of a dry section of the fleece web. The introduction of the liquid medium is advantageously performed with the provision that the above-described amount of liquid medium remains in the nonwoven fleece web sent for preconsolidation. —It is also within the scope of the invention that introduction of the liquid medium into the nonwoven fleece web does not involve a consolidation measure and/or is not a hydrodynamic consolidation.

According to an especially preferred embodiment of the invention, the preconsolidation of the nonwoven fleece web is performed by mechanical needling with a puncture density of less than 75 punctures/cm$^2$ (E/cm$^2$), preferably less than 60 punctures/cm$^2$ and especially preferably less than 50 punctures/cm$^2$. The puncture density in mechanical needling is in particular 5 to 75 punctures/cm$^2$, advantageously 10 to 50 punctures/cm$^2$, preferably 10 to 40 punctures/cm$^2$ and very preferably 12 to 30 punctures/cm$^2$. This presolidification serves to stabilize the deposition of fibers and/or the nonwoven fleece web for further treatment. This preconsolidation is advantageously performed by mechanical needling on the deposition surface and/or on the deposit belt/screen belt on which the filaments are deposited to form the nonwoven fleece web. It is within the scope of the invention for the preconsolidated nonwoven fleece web to be removed from the deposition surface and sent to at least one additional device and/or conveyor apparatus for the purposes of further treatment.

According to one embodiment of the invention, the mechanically preconsolidated nonwoven fleece web is transversely stretched in a transverse stretcher before the hydrodynamic final consolidation, preferably being transversely stretched in the range of 5% to 50%. The transverse strength and the transverse dimensional stability are to be increased in this way. Known measures such as arc rolling, tenter frame systems, etc. may basically be used. When using a tenter frame, it may be advantageous to select an exit speed from this transverse stretcher such that this speed is lower than the entrance speed in order to achieve a more effective reorientation of the filaments while at the same time minimizing transverse stretching forces. Such transverse stretching would advantageously take place in a temperature range below the melting point of the nonwoven web raw material.

According to a preferred embodiment that is especially important within the scope of the invention, the nonwoven fleece web is premoistened after the mechanical needling and before the hydrodynamic consolidation and/or final consolidation. Then the hydrodynamic consolidation is performed by water-jet treatment in at least one water-jet unit. According to a recommended embodiment, the premoistening is performed by an upstream water-jet unit, in particular by an upstream water-jet bar upstream of the actual water-jet unit for the final consolidation and is operated at a low water pressure. "Low water pressure" refers in particular to a water pressure of 5 to 120 bar and preferably from 20 to 100 bar. The higher water pressures relate in particular to heavier nonwoven fleece web having a higher basis weight of 200 g/m$^2$, for example. Lighter nonwoven fleece web are premoistened at lower water pressures. It is within the scope of the invention for the premoistening to be performed with the provision that no significant compaction of the filament deposit and/or the nonwoven fleece web takes place. According to another embodiment the premoistening may also be performed by a sprayer with which water or an aqueous solution and/or an aqueous mixture is sprayed onto the nonwoven fleece web. Then there is advantageously a suction removal and/or through-suction of the fluid. The premoistening of the nonwoven fleece web with water and/or with an aqueous system produces a better transfer of momentum in the downstream hydrodynamic consolidation/final consolidation. One alternative consists of introducing hydrophilic substances and/or additives into the nonwoven fleece web. This can also improve the transfer of momentum. —According to one embodiment of the invention, the premoistening described above may also be omitted if the introduction of a liquid medium and/or a hydrophilic liquid medium as described above is performed between the deposition of the filaments to form the nonwoven fleece web and the mechanical needling of the nonwoven fleece web.

An especially recommended embodiment of the invention is characterized in that the water-jet treatment in the hydrodynamic final consolidation is performed from the top side as well as from the bottom side of the nonwoven fleece web. The top side of the nonwoven fleece web here refers to the side of the nonwoven fleece web facing the filament stream to be deposited. It is within the scope of the invention for the water-jet treatment to be performed in the hydrodynamic final consolidation using high-pressure water jets. High-pressure water jets refers in particular to water jets having a water pressure of more than 120 bar, advantageously from 130 to 450 bar, preferably from 150 to 400 bar.

A very preferred embodiment that is especially important within the scope of the invention is characterized in that the water-jet treatment in the hydrodynamic final consolidation is performed using at least one high-pressure water-jet bar above the top side of the nonwoven fleece web and using at least one high-pressure water-jet bar underneath the lower side of the nonwoven fleece web. Then the top side of the nonwoven fleece web is acted upon by the high-pressure water jets of the one high-pressure water-jet bar and the lower side of the nonwoven fleece web is acted upon by the high-pressure water jets of the other high-pressure water-jet bar. It is within the scope of the invention for one high-pressure water jet bar to extend across the travel direction and/or the direction of transport of the nonwoven fleece web. A high-pressure water-jet bar has a plurality of nozzles that are distributed over the length of the bar and out of which the high-pressure water jets emerge. According to a preferred embodiment of the invention, only two high-pressure water-jet bars are provided, one of which is provided above the top side of the nonwoven fleece web and the other of which is provided underneath the lower side of the nonwoven fleece web. Advantageously at most four high-pressure water-jet bars are provided for the hydrodynamic and/or hydraulic final consolidation. According to one embodiment, if more than four high-pressure water-jet bars are used, then the upstream four high-pressure water bars with respect to the travel direction of the nonwoven fleece web will perform at least 80% of the total hydraulic work of the hydraulic final consolidation. The comparisons of the hydraulic work and/or of the hydraulic consolidation work are based here and below in particular on one nozzle bore each of the bars and/or high-pressure water-jet bars to be compared. Thus in particular the hydraulic work per nozzle bore of the bars is compared.

When working with at least two high-pressure water-jet bars, according to one embodiment, these two high-pressure water-jet bars differ with respect to the water pressure of the high-pressure water jets emerging from them and/or with respect to the nozzle hole density in hpi (nozzle bores or nozzle holes per inch of width) and/or with respect to the nozzle hole diameter. The high-pressure water jets of the upstream high-pressure water-jet bar with respect to the travel direction of the nonwoven fleece web advantageously penetrate through the entire thickness of nonwoven fleece web and/or essentially the total thickness of the nonwoven fleece web. Then the downstream high-pressure water-jet bar with respect to the travel direction of the nonwoven fleece web acts from the opposite side of the nonwoven fleece web. High-pressure water jets of this downstream high-pressure water-jet bar advantageously penetrate through at least 25%, preferably at least 30% of the nonwoven fleece web thickness. The energy or hydrodynamic energy of the upstream high-pressure water-jet bar can be reduced to the extent to which the high-pressure water jets of the downstream high-pressure water-jet bar penetrate through the thickness of the nonwoven fleece web. According to a recommended embodiment of the invention, the hydraulic consolidation/final consolidation is effective through the entire thickness of the nonwoven fleece web thickness, or essentially through the entire thickness of the nonwoven fleece web using at least one high-pressure water-jet bar of the upstream pair of high-pressure water-jet bars with respect to the travel direction of the nonwoven fleece web. Any other downstream high-pressure water-jet bars then advantageously act only on filaments near the surface and serve to provide secondary smoothing of the nonwoven fleece web surface and/or the nonwoven fleece web surfaces.

It is within the scope of the invention for the hydraulic consolidation to work with a plurality of high-pressure water-jet bars in hydraulic consolidation and for the high-pressure water-jet bar having the highest hydraulic consolidation work to have at least a 33% share, preferably at least a 40% share and more preferably at least a 50% share of the total hydraulic consolidation work of the water-jet consolidation. It is advisable for the high-pressure water-jet bar having the highest hydraulic consolidation work to be the first or second or third high-pressure water-jet bar with respect to the travel direction of the nonwoven fleece web, preferably to be the farthest upstream or downstream high-pressure water-jet bar. The total hydraulic consolidation work of the hydraulic consolidation preferably amounts to less than 1 kWh/kg, preferably less than 0.8 kWh/kg.

According to a particularly recommended embodiment of the invention, the hydraulic consolidation operates with a water-jet unit in particular having at least one high-pressure water-jet bar that has a hole density of less than 40 hpi, preferably less than 35 hpi and especially less than 30 hpi, where hpi denotes "holes per inch of width" or "nozzle bores per inch of width." The is upstream high-pressure water-jet bar following the premoistening advantageously has the above-described hole density. The high-pressure water-jet bar having the highest hydraulic consolidation work preferably has the above-described hole density. If the upstream high-pressure water-jet bar with respect to the travel direction of the nonwoven fleece web has the above-described hole density, then the additional high-pressure water-jet bar(s) downstream advantageously has (have) a higher hole density than the upstream high-pressure water-jet bar. The upstream high-pressure water-jet bar in the travel direction of the nonwoven fleece web preferably has a hole density of 20 to 30 hpi, and the downstream high-pressure water-jet bar downstream has a hole density of 25 to 35 hpi, where the hole density of the downstream high-pressure water-jet bar is higher than the hole density of the upstream high-pressure water-jet bar. If a third high-pressure water-jet bar is provided downstream, this one preferably has a hole density of 30 to 45 hpi and especially a hole density of 35 to 45 hpi, where the hole density of the third high-pressure water-jet bar is higher than the hole density of the upstream high-pressure water-jet bar and, preferably, is also higher than the hole density of the downstream high-pressure water-jet bar.

According to a recommended embodiment, the hydraulic consolidation operates with a water-jet unit, in particular with a high-pressure water-jet bar that is characterized by a hole diameter or nozzle bore diameter of 0.08 to 0.25 mm, preferably 0.08 to 0.15 mm, especially 0.09 to 0.13 mm for example 0.12 mm. All the high-pressure water-jet bars of the hydraulic consolidation advantageously have the above-described hole diameter and/or the above-described nozzle bore diameter. According to a preferred embodiment of the invention, the upstream high-pressure water-jet bar in the travel direction of the nonwoven fleece web has a larger hole diameter than the downstream high-pressure water-jet bar (s). The upstream high-pressure water-jet bar preferably has a hole diameter of 0.10 to 0.18 mm, especially 0.12 to 0.16 mm and, for example, 0.14 mm. The downstream high-pressure water-jet bar in the travel direction advantageously has a hole diameter of 0.08 to 0.16 mm, preferably 0.10 to 0.14 mm and, for example, 0.12 mm. If a third high-pressure water-jet bar is provided, it is advisable for the latter to have finer nozzles or smaller hole diameters than the upstream high-pressure water-jet bar.

It is within the scope of the invention to operate with a water pressure of more than 120 bar, advantageously more than 150 bar in the hydraulic consolidation and/or with the high-pressure water-jet bars. The upstream high-pressure water-jet apparatus in the travel direction of the nonwoven fleece web or the upstream high-pressure water-jet bar in the travel direction is according to recommendation operated at a water pressure of more than 220 bar, preferably more than 250 bar. According to a preferred embodiment, the downstream high-pressure water-jet unit in the travel direction and/or the high-pressure water-jet bar in the travel direction is (are) operated at a water pressure of more than 220 bar, preferably more than 250 bar. The upstream high-pressure water-jet unit in the travel direction or the upstream high-pressure water-jet bar in the travel direction is preferably provided on one side of the nonwoven fleece web, whereas the downstream high-pressure water-jet unit in the travel direction and/or the downstream high-pressure water-jet bar in the travel direction is (are) provided on the opposite side of the nonwoven fleece web. If at least one downstream high-pressure water-jet unit or at least one downstream high-pressure water-jet bar is provided in the travel direction of the nonwoven fleece web, this is advantageously operated at a water pressure of more than 120 bar to 220 bar. This downstream high-pressure water-jet bar or these bars serve primarily to smooth the surfaces of the nonwoven.

The inventive hydraulic consolidation may be performed in an inline process or in an offline process. With inline operation, the hydraulic consolidation is performed continuously after mechanical needling and preferably before premoistening. In offline operation the preconsolidated nonwoven fleece web is first stored, for example after rolling up in rolls and is subsequently sent for hydraulic consolidation or for premoistening and then is hydraulic consolidation.

It is within the scope of the invention that the hydraulically consolidated nonwoven fleece web is dried. According to one embodiment of the invention, the hydraulically consolidated nonwoven fleece web is transversely stretched and/or thermally stabilized during or after the drying. In the case of transverse stretching, temperatures in the range from room temperature up to the softening temperature of the plastic or slightly above are advantageous. In thermal stabilization, the temperatures are between the softening point and the melting point of the plastic.

A very preferred embodiment of the invention is characterized in that the final consolidated and dried plus optionally transversely stretched nonwoven fleece web has a basis weight of more than 130 g/m$^2$, preferably more than 150 g/m$^2$, especially more than 180 g/m$^2$ and especially preferably more than 200 g/m$^2$. The inventive method is suitable in particular for nonwoven fleece web and/or a spunbond nonwoven having higher basis weights.

The subject matter of the invention is also an apparatus for making a spunbond nonwoven from filaments, in particular from a thermoplastic plastic, where a spinner is provided for spinning the filaments, a cooler is provided for cooling the filaments and a stretcher connected thereto is provided for stretching or for aerodynamic stretching of the filaments and a mat-forming device is provided for depositing the filaments to form the nonwoven fleece web, wherein furthermore at least one needler and/or needle loom is (are) provided that can preconsolidate the nonwoven fleece web by mechanical needling, and at least one water-jet unit is provided that can hydrodynamically or hydraulically final consolidate the nonwoven fleece web and that can perform the water-jet treatment for hydraulic final consolidation from the top side and from the bottom side of the nonwoven fleece web.

The water-jet unit is equipped with means for performing the water-jet treatment of the nonwoven fleece web from the top side and from the bottom side of the nonwoven fleece web. It is within the scope of the invention that a premoistener for premoistening the nonwoven fleece web is provided upstream from the water-jet unit.

According to an especially preferred embodiment of the invention, the filaments leaving the spinner are treated according to the Reicofil III method (DE19620379 [U.S. Pat. No. 5,814,349]) or according to the Reicofil IV method (EP 1340843 [U.S. Pat. No. 6,918,750]). It is within the scope of the invention for the transitional area between the cooler or the cooling and the stretcher to be designed so that it is closed and for no additional air to be supplied to this transitional area except for the supply of cooling air in the cooling chamber. It is within the scope of the invention for a closed cooling chamber to be used. The phrase "closed cooling chamber" means that the cooling chamber is designed to be sealed off from the environment except for the supply of cooling air. According to an especially preferred embodiment of the invention, the filaments are cooled with the same air or cooling air in the cooler and are then stretched in the stretcher. In other words essentially the cooling air supplied to the cooling chamber is also used for aerodynamic stretching of the filaments in the stretcher. An especially recommended embodiment of the invention is characterized in that the entire system of the cooler and the stretcher is designed to be closed, and no additional air is supplied to this system except for the supply of cooling air into the cooling chamber.

The invention is based on the discovery that with the inventive method and with the inventive apparatus, it is possible to produce a spunbond nonwoven characterized by optimal properties and to do so with relatively low energy consumption. The spunbond nonwoven has an excellent strength and delamination resistance with an energy-efficient method of making the spunbond nonwoven. The hydraulic or hydrodynamic consolidation in particular can be operated with minimal power consumption. The inventive apparatus can be operated with a smaller number of water-jet bars or high-pressure water-jet bars in comparison to the apparatuses known from practice and therefore it is less complicated and has a less complex design. The inventive method is suitable in particular for a spunbond nonwoven having a basis weight greater than 100 g/m$^2$ and in particular above 150 g/m$^2$. The inventive method also offers special advantages for a spunbond nonwoven having filaments with low titers. It should also be emphasized that the inventive method and the inventive apparatus can be operated at a relatively low cost.

BRIEF DESCRIPTION OF THE DRAWING

The invention is explained in greater detail below on the basis of figures that illustrate only one illustrated embodiment. Therein.

DETAILED DESCRIPTION OF THE INVENTION

Figure 1:
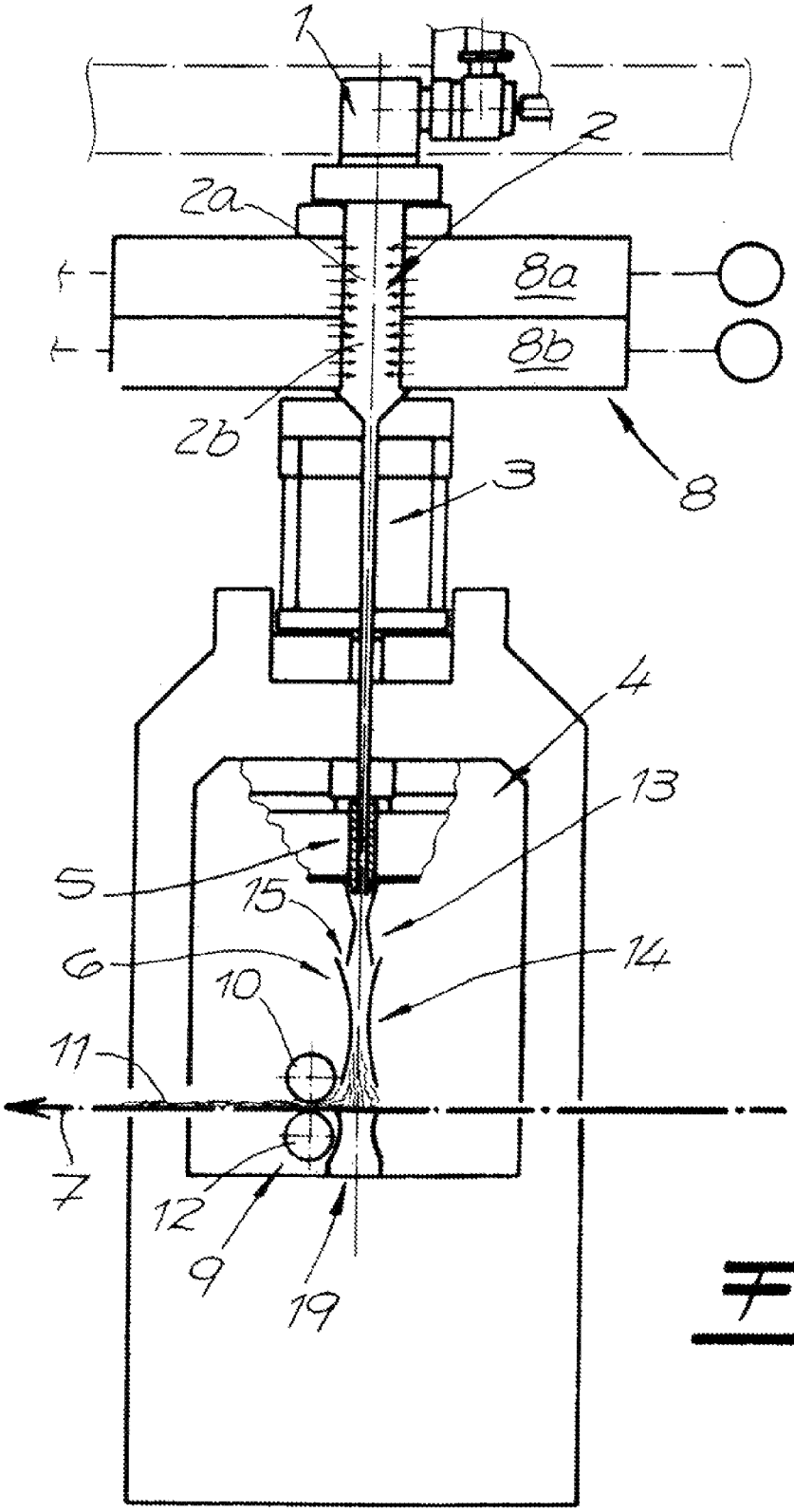
FIG. 1 is a schematic a vertical section through an upstream part of the inventive apparatus.

The figures show an apparatus for making a spunbond nonwoven from filaments that preferably consist of thermoplastic material. The filaments are spun using a spinner or spinneret 1 and are then introduced into a cooling chamber 2 where the filaments are cooled with cool air. The cooling chamber 2 in this embodiment is subdivided into two cooling subchambers 2*a* and 2*b*. In addition to the cooling chamber 2, there is an air supply means 8 that has an upper supply compartment 8*a* and a lower supply compartment 8*b*. Cooling air having different convective heat dissipation capacities is advantageously supplied from the two supply compartments 8*a* and 8*b*. Cooling air of different temperatures can preferably be supplied from the two compartments 8*a* and 8*b*. The filaments may be acted upon by cooling air of different temperatures and/or different quantities and/or different atmospheric humidities in the two cooling subchambers 2*a* and 2*b*.

A stretcher 4 that advantageously and in this embodiment consists of an intermediate passage 3 and a lower passage 5 connected to the intermediate passage 3 is connected to the cooling chamber 2. According to a preferred embodiment and in this embodiment, a spreader 6 having at least one diffuser 13, 14 is connected to the stretcher 4. In this embodiment, two diffusers are provided, namely an upstream diffuser 13 and a downstream diffuser 14 connected to the former. According to a recommended embodiment and in the embodiment according to FIG. 1, an ambient air inlet gap 15 is provided between the upstream diffuser 13 and the downstream diffuser 14.

Advantageously and in this embodiment, a continuously moving foraminous belt 7 for deposition of the filament to form a nonwoven fleece web 11 is provided underneath the spreader 6. According to an especially preferred embodiment and in the embodiment according to FIG. 1, no air supply from the outside is provided in the area of the cooling chamber 2 and the stretcher 4 apart from the supply of cooling air to cool the filaments in the cooling chamber 2. Preferably and in the embodiment according to FIG. 1, except for the above-described air supply there is no additional air supply from the outside throughout the entire system comprised of the cooling chamber 2 and the stretcher 4. This is a so-called closed system. According to one variant and in the embodiment according to FIG. 1, there is no additional supply of air in the entire system consisting of the cooling chamber 2, stretcher 4 and spreader 6, apart from the air supply described above and the air supply through the ambient air inlet gap 15.

In the embodiment according to FIG. 1, the filaments emerging from the downstream diffuser 14 are deposited on the screen belt 7 to form the nonwoven fleece web 11. Advantageously and in the embodiment, a suction device 19 that draws air from underneath down through the screen belt 7 is provided in this deposition area for the filaments underneath the air permeable screen belt 7. According to the embodiment shown in FIG. 1, downstream from the above-described deposition area and/or suction area in the travel direction of the nonwoven fleece web there is compacting means 9 that here consists of two driven rollers 10, 12 that are advantageously heated. The rollers 10, 12 are not absolutely necessary, however.

Figure 2:
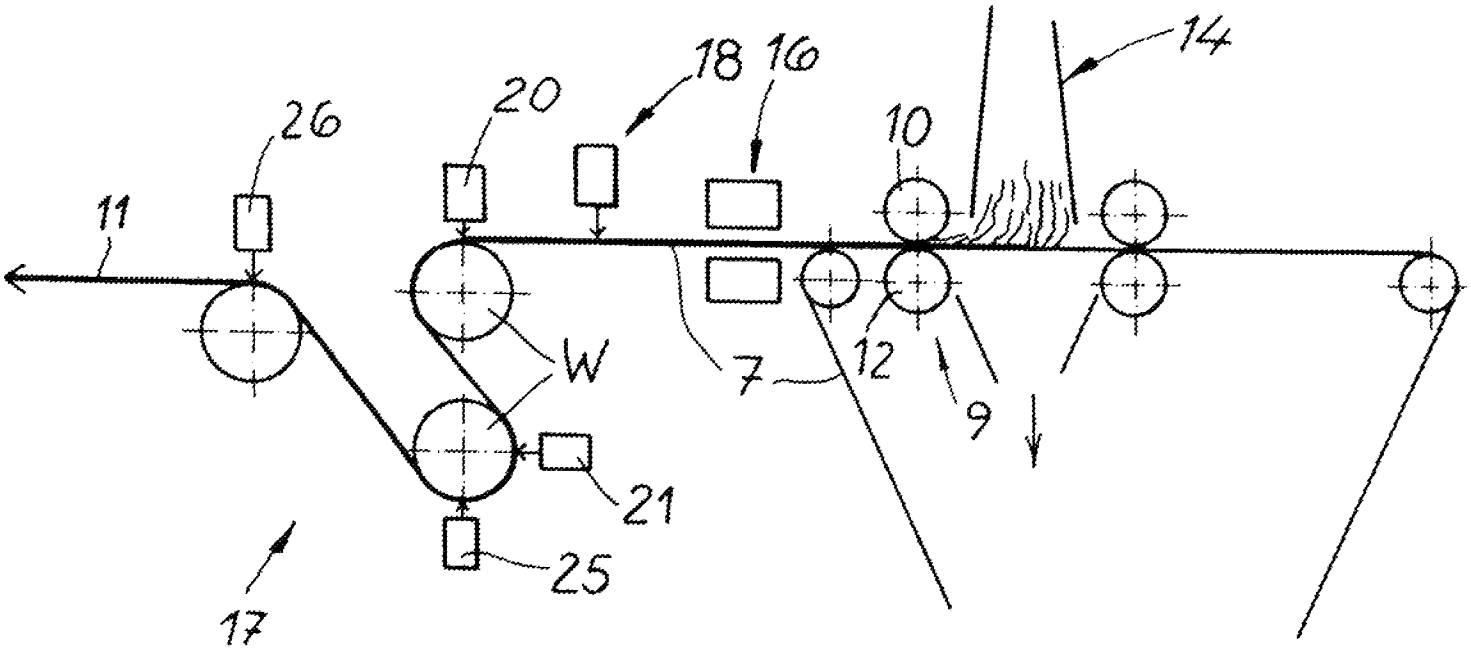
FIG. 2 is a schematic a vertical section through a downstream part of the inventive apparatus and FIG. 3 is a view like to FIG. 2 of a different embodiment.

FIG. 2 shows a downstream section of the inventive apparatus. After deposition of the filaments on the screen belt and optionally after passing through the compactor 9, the nonwoven fleece web leaves the screen belt 7 and then is passed through a needler 16 (needle loom) where the nonwoven fleece web 11 is mechanically preconsolidated by needling. The nonwoven fleece web 11 preconsolidated in this way is then sent to a water-jet unit 17, where the nonwoven fleece web 11 is final consolidated hydraulically and/or hydrodynamically. Before the final consolidation, the nonwoven fleece web 11 is prewetted with a premoistener 18. The premoistener 18 is advantageously and in the embodiment according to FIG. 2 designed as a water-jet bar extending across the travel direction of the nonwoven fleece web 11. The water-jet bar is operated only at a low water pressure in contrast with downstream high-pressure water-jet bars 20, 21, 25 and 26.

The embodiment according to FIG. 2 operates using one water-jet bar as the premoistener 18 and four high-pressure water-jet bars 20, 21, 25 and 26 as the water-jet unit 17 for the hydrodynamic and/or hydraulic final consolidation. The water-jet bars of the premoistener 18 advantageously have a nozzle bore diameter of 0.08 to 0.15 mm, preferably 0.10 to 0.14 mm and, for example, a nozzle bore diameter of 0.12 mm. Preferably, this water-jet bar has a hole density or hole bore density of 35 to 45 hpi, in particular a hole density of 40 hpi. The water-jet bar of the premoistener 18 is advantageously operated at a water pressure of 5 to 120 bar, preferably with a water pressure of 20 to 110 bar and with a water pressure of 100 bar, for example. The two high-pressure water-jet bars 20, 21 of the water-jet unit 17 each preferably has a nozzle bore diameter of 0.08 to 0.16 mm. The upstream high-pressure water-jet bar 20 is characterized according to a preferred embodiment of the invention by a hole density or a nozzle bore density of less than 40 hpi, preferably less than 30 hpi, for example, of 25 hpi. The downstream high-pressure water-jet bar 21 has a higher hole density in comparison with that, namely preferably a hole density greater than 25 hpi for example a hole density of 30 hpi. The upstream and downstream high-pressure water-jet bars 20, 21 are advantageously operated at a water pressure of more than 220 bar. The water pressure of the two downstream high-pressure water-jet bars 25 and 26 is preferably between 130 and 220 bar. The two high-pressure water-jet bars 25 and 26 act primarily on filaments near the surface and serve to subsequently smooth the nonwoven fleece web surface.

After the hydraulic final consolidation, the nonwoven fleece web 11 is advantageously dried. During this process, the residual water content from the water-jet final consolidation is removed.

Figure 3:
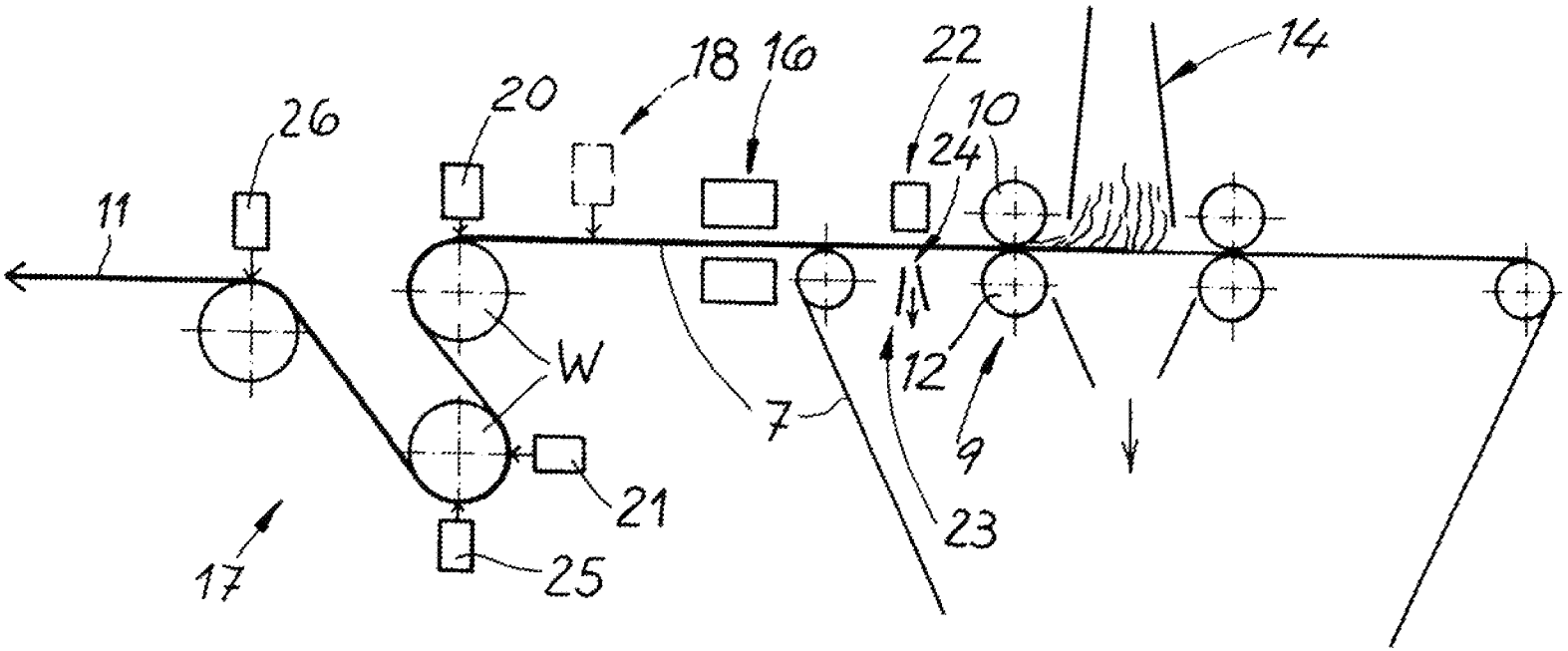

FIG. 3 shows another embodiment of the inventive apparatus, where a liquid medium is applied to the nonwoven fleece web between the deposition of the filament and are between the discharge rollers 10, 12 and the needler 16. To do so a device 22 is provided with which the liquid medium is applied from above to the nonwoven fleece web 11. An intake device 23 that sucks the liquid medium applied by the device 22 into the nonwoven fleece web 11 is provided underneath the nonwoven fleece web 11 and/or underneath the screen belt 7. Preferably and in the embodiment, this suction device 23 has a suction slot 24 extending across the travel direction of the nonwoven fleece web 11. In this embodiment, with the application of a liquid medium, premoistening before the hydrodynamic final consolidation may also omitted. Therefore, in FIG. 3 the optional premoistener 18 is shown with dash-dot lines.

The invention claimed is:

1. A method of making a spunbond nonwoven from thermoplastic filaments, the method comprising the steps of sequentially:

spinning the filaments from at least one spinner;

cooling and stretching the spun filaments;

depositing the cooled and stretched filaments via at least one diffuser on a surface to form a nonwoven fleece web;

moving the fleece web in a travel direction;

introducing a hydrophilic liquid medium into the moving fleece web in an amount of 0.2% to 25% based on the weight of the dry nonwoven fleece web or the weight of a dry area section of the nonwoven fleece web;

mechanically needling the moving fleece web into which the liquid medium was introduced;

premoistening the needled and moving fleece; and hydraulically or hydrodynamically final consolidating by hydroentanglement the mechanically needled and moving fleece web to a basis weight of more than 80 g/m$^2$ from a top side as well as from a lower side of the nonwoven fleece web by high-pressure water-jet bars above and below the nonwoven fleece web, one of the bars being upstream of the other bar, being operated at a higher pressure than the other bar, and having a hpi density that is smaller than that of the other bar and that is equal to at most 40.

2. The method defined in claim 1, wherein the basis weight after final consolidation is more than 100 g/m$^2$.

3. The method defined in claim 1, wherein the amount is 0.3 to 20%.

4. The method defined in claim 1, wherein the amount is 0.4 to 15%.

5. The method defined in claim 1, wherein the mechanical needling of the nonwoven fleece web is performed with a puncture density of less than 70 E/cm$^2$.

6. The method defined in claim 1, wherein the hydraulic final consolidation is effected by a plurality of high-pressure water-jet bars with the bar doing the most hydraulic consolidation work having at least a 33% share of the total consolidation work.

7. The method defined in claim 6, wherein one of the water-jet bars carries out at least a 40% share of the total hydraulic consolidation work.

8. The method defined in claim 1, wherein the total hydraulic consolidation work is less than 1 kWh/kg.

9. The method defined in claim 8, wherein the total hydraulic consolidation work is less than 0.8 kWh/kg.

10. The method defined in claim 1, wherein the hole density of the one bar is less than 30 hpi.

11. The method defined in claim 1, wherein the one high-pressure water-jet bar has a hole diameter of 0.08 to 0.25 mm.

12. The method defined in claim 11, wherein the hole diameter is from 0.10 to 0.16 mm.

13. The method defined in claim 1, wherein the one upstream high-pressure water-jet bar is operated at a water pressure of more than 220 bar and the other downstream high-pressure water-jet bar is operated at a water pressure between 130 and 220 bar.

14. The method defined in claim 1, wherein the final consolidated fleece web has a basis weight of more than 130 g/m$^2$.

15. The method defined in claim 14, wherein the basis weight is more than 150 g/m$^2$.

* * * * *